United States Patent [19]

Broadus et al.

[11] Patent Number: 4,609,042

[45] Date of Patent: Sep. 2, 1986

[54] INFLATABLE SAFETY BLADDER

[75] Inventors: Ronnie J. Broadus, P.O. Box 418, Belle Chasse, La. 70037; Randall Slade, Belle Chasse, La.; John W. Wegner, Deer Park, Tex.

[73] Assignee: Ronnie J. Broadus, New Orleans, La.

[21] Appl. No.: 669,237

[22] Filed: Nov. 7, 1984

[51] Int. Cl.[4] ..... E21B 33/127

[52] U.S. Cl. ..... 166/187; 138/93; 220/239

[58] Field of Search ..... 166/99, 187; 52/2, DIG. 12; 138/89.4, 93; 220/239

[56] References Cited

U.S. PATENT DOCUMENTS

| | | | |
|---|---|---|---|
| 1,487,061 | 3/1924 | Heflin | 166/99 |
| 2,717,644 | 9/1955 | Bell et al. | 166/187 |
| 3,181,608 | 5/1965 | Palmer | 166/187 |
| 3,232,207 | 2/1966 | Gibbons | 220/239 |
| 4,406,461 | 9/1983 | McGill | 166/187 |

FOREIGN PATENT DOCUMENTS

| | | | |
|---|---|---|---|
| 889694 | 1/1972 | Canada | 166/187 |

*Primary Examiner*—Stephen J. Novosad
*Assistant Examiner*—William P. Neuder
*Attorney, Agent, or Firm*—Keaty & Keaty

[57] ABSTRACT

A casing safety device and method are disclosed for preventing tools from falling into an open well casing and for venting gases to a distance above the open mouth of the casing. An inflatable bladder is provided for placement in the casing adjacent the open mouth, and the bladder is inflated to block the casing and provide a stop against which falling tools come to rest. Damage to the bladder is prevented by a circular rubber shroud disposed between the bladder and the open mouth of the casing which reduces the velocity of falling objects before they strike the bladder. A vent is also provided for conveying downhole fluids, such as flammable gases, to a distance above the open mouth of the casing.

21 Claims, 3 Drawing Figures

INFLATABLE SAFETY BLADDER

BACKGROUND OF THE INVENTION

1. Field of the Invention

This invention concerns an inflatable safety bladder for use as a casing safety device for preventing tools from falling into well casings and for venting downhole gases to a safe distance above the top of the well casing. The safety device can be used with water wells or any other opening in the ground around which people work.

2. Discussion of the Prior Art

When oil or gas wells are drilled, a well casing is usually inserted into the hole to prevent the walls of the hole from collapsing. This casing also provides a conduit through which oil and gas is conveyed from subterranean areas to the surface of the ground. A variety of mechanical tasks are performed near the mouth of the casing with small tools such as wrenches and it often happens that these tools slip into the casing and fall to the bottom of the well. When this happens, it is necessary to interrupt the drilling operation and use special devices to fish the tool out of the casing. Such interruptions are costly, inefficient, and time-consuming.

Another problem experienced by persons working near the open mouth of the casing is that explosive or otherwise dangerous gases sometimes seep into the casing, rise to the surface, and are expelled through the open mouth of the casing. If, for example, a worker is using a welding torch near the open mouth of the casing and an inflammable gas is at the same time being expelled from subterranean levels, a fire or explosion often occurs.

No prior art devices have been suitable for preventing the dropping of tools into the well casing or for venting dangerous gases to a safe distance above the open mouth of the casing. For example, U.S. Pat. Nos. 2,629,446, 2,681,706, 3,039,533, 3,393,744, 4,406,461 and 3,493,045 all disclose inflatable drilling hole packers which are placed deep in a hole which has been drilled to seal the hole and prevent the egress of oil and gas from the hole. Because of their placement deep in the hole, they are unsuitable for preventing tools from dropping deep into the hole. These packers are also adapted for use only in the hole, and not in conjunction with a well casing. The packers of these patents are high pressure vessels which are designed to withstand the enormous forces exerted by subterranean oil and gas formations, and are accordingly quite differently constructed than the low pressure bladder of the instant invention. Another drawback of these prior art bladders is that none of them provide a means for venting fluids from the downhole side of the bladder to a safe distance above the open mouth of the casing.

Accordingly, it is an object of this invention to provide a casing safety device for preventing tools from falling into a well casing.

It is also an object of the instant invention to provide a safety device for venting downhole gases or other fluids to a safe distance above the open mouth of the well casing.

It is further an object to provide a low pressure bladder which is relatively inexpensive to construct and easy to inflate.

Another object of the invention is to provide a semi-rigid shroud between the open mouth of the casing and the inflatable bladder to reduce the velocity of falling tools and prevent them from puncturing or damaging the bladder.

It is also an object of the invention to provide a bladder which is designed for placement adjacent the open mouth of the well casing so that tools dropped into the casing can be retrieved merely by reaching into the open mouth and pulling the tools out manually without the necessity for using fishing tools.

SUMMARY OF THE INVENTION

These objects are achieved and the problems of the prior art overcome by providing an inflatable, resilient bladder for placement in the well casing adjacent the upper end of the casing. The bladder is conformable in at least partially sealing relationship to the walls of the casing when inflated. A hollow core through said bladder passes fluid from the downhole side of the bladder to the top side of it, where the core is fluidly connected to a hollow handle which operates as a vent for conveying the fluids to a safe distance above the open mouth of the well casing. The hollow handle and core also serve as a conduit through which pressurized fluid may be introduced into the bladder. A semi-rigid, circular shroud is concentrically disposed around the hollow handle between the bladder and the open mouth of the casing to reduce the impact of falling objects and prevent them from puncturing the bladder. A dump valve is provided for quickly deflating the bladder to remove it from the casing, and a relief valve is also provided for preventing the introduction of excessively pressurized fluid into the bladder.

A method is also disclosed for preventing tools from falling into a well casing in which an inflatable, resilient bladder is placed in the casing adjacent the open mouth of the casing, and the bladder is inflated. In alternate embodiments, the method also includes provision of a vent for conveying gases passed through the core of the bladder to a safe distance above the casing.

DETAILED DESCRIPTION OF THE PREFERRED EMBODIMENTS

Figure 1:
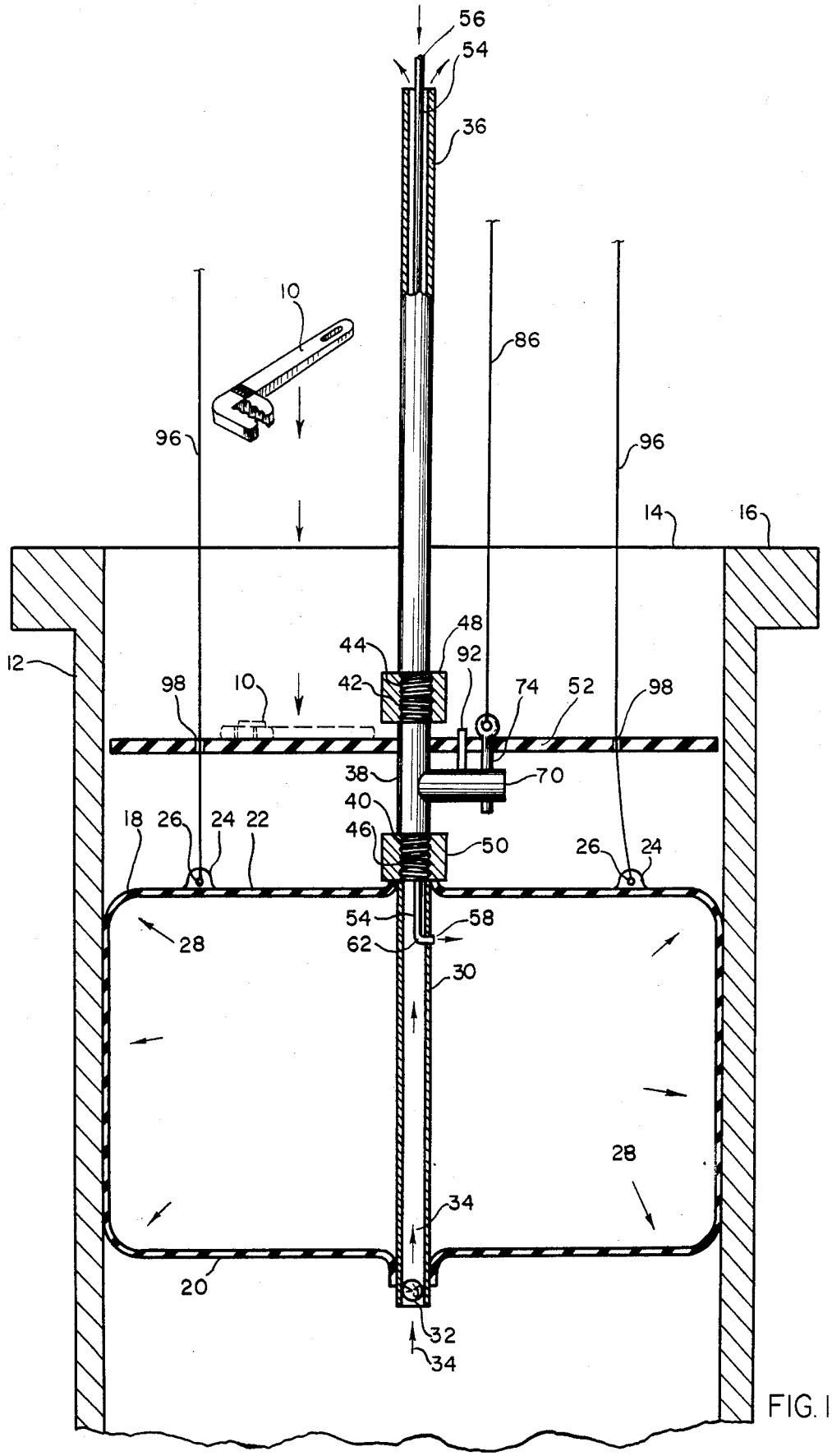
FIG. 1 is a cross-sectional view of a first embodiment of the inflated bladder disposed in a well casing adjacent the open mouth of the casing, portions of the handle being broken away for clarity.
Figure 2:
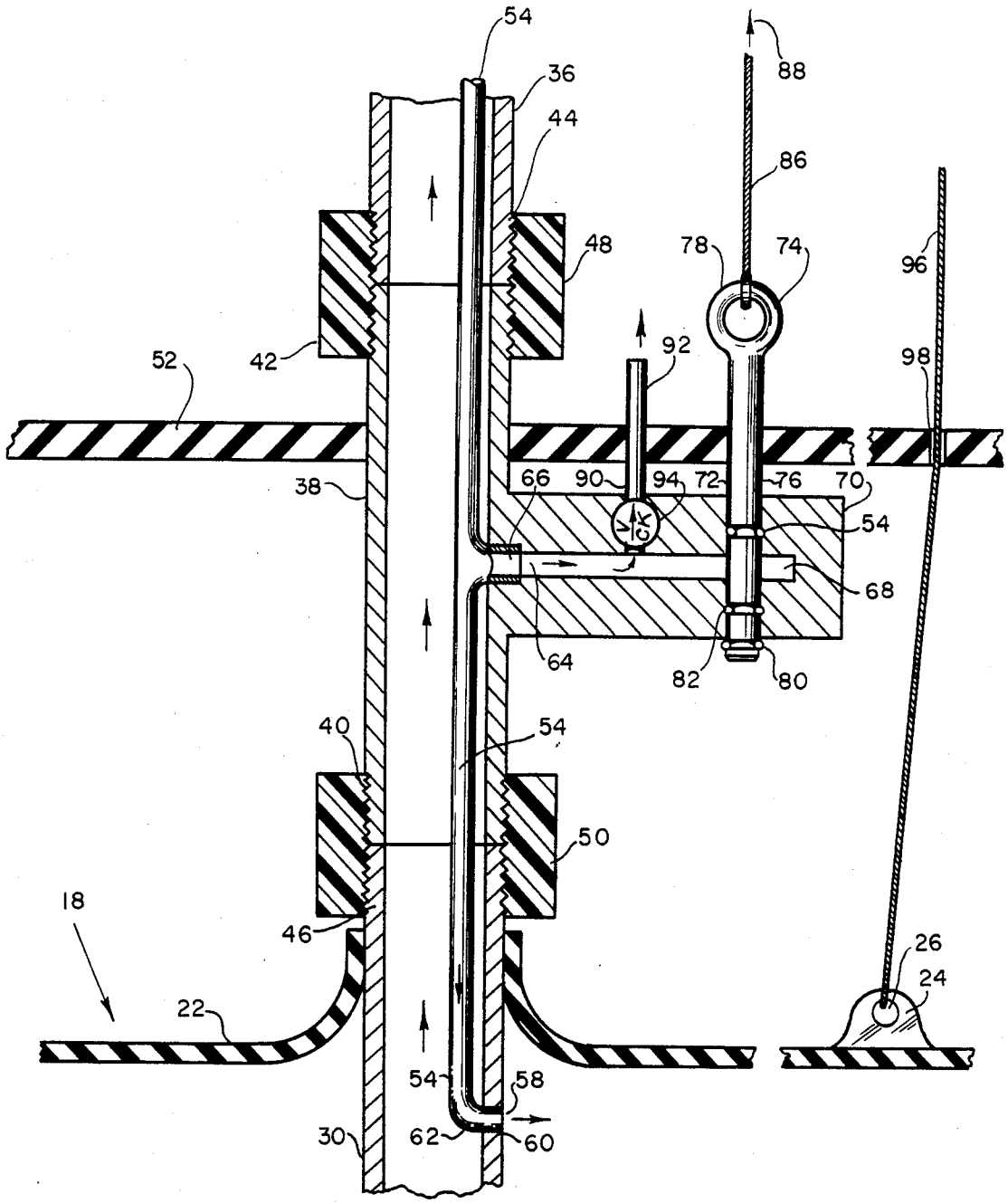
FIG. 2 is an enlarged, fragmentary view of the bladder shown in FIG. 1 in which an elongated tube passes through the handle to introduce fluid into the bladder, and also showing a tributary line in which the relief valve and dump valve are disposed.
Figure 2:
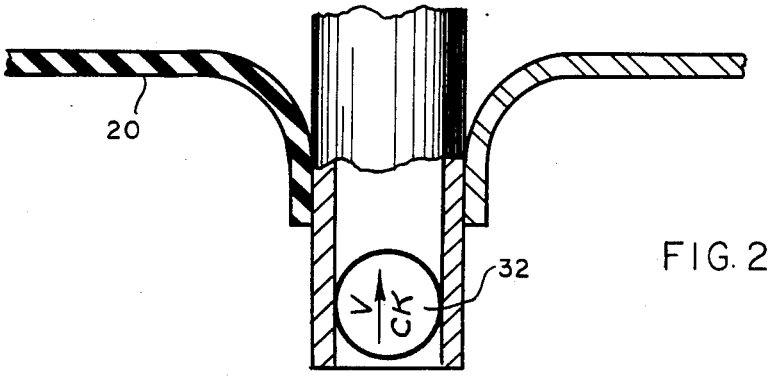

A casing safety device is shown in FIGS. 1 and 2 for preventing tools, such as wrench 10, from falling into a well casing 12 and for venting downhole gases to a safe distance above the open mouth 14 of casing 12, wherein mouth 14 is defined by an annular flange 16 circumferentially disposed around the topmost portion of casing 12. The safety device is comprised of an inflatable, resilient bladder 18 which is made of a rubberized fabric, molded rubber or polyurethane and is seamed or bonded to a core, which will be described below. The resilient bladder is of a sufficient diameter that it is conformable in at least partially sealing relationship to the walls of the casing 12 when bladder 18 is inflated. Bladder 18, when inflated, presents a downhole side 20 and top side 22. Loops 24 are fixed to side 22 of bladder 18, and each of loops 24 are provided with an opening 26. The arrows 28 inside bladder 18 schematically demonstrate the inside pressure exerted by a fluid introduced into bladder 18 for maintaining it in an inflated condition.

A hollow core 30 is provided for bladder 18 through which fluid may pass from the downhole side 20 to the top side 22 of bladder 18. Bladder 18 is sealed or bonded to the outside wall of core 30 to prevent pressurized fluid from escaping from the interior of bladder 18 to the exterior thereof, and also for preventing the ingress of downhole gases into the interior of bladder 18. A check valve 32 is disposed near the bottom of core 30, the bottom of core 30 being open so that fluids under pressure may pass from downhole side 20 of the bladder into the interior of core 30. Check valve 32 permits fluids to flow in the direction of arrow 34 but prevents the flow of fluid in the opposite direction. The pressurized fluids represented by arrows 34 are in the nature of drilling mud or gases, some of the gases being toxic or flammable.

The casing safety device is also provided with a hollow, elongted handle 36 which is in fluid communicating relationship with the interior of core 30 for venting fluid passed through check valve 32 to a safe distance above the mouth 14 of casing 12. A safe distance above mouth 14 could be, for example, 10 feet above mouth 14, but the length of handle 36 is obviously subject to wide variation. Handle 36 is held in fluid communicating relationship with core 30 through a tee 38. Tee 38 is, in some embodiments, provided with external threads 40, 42 at the bottom and top of tee 38 respectively. Handle 36 is provided with external threads 44 of the same size and direction at the portion of handle 36 which abuts tee 38. Similarly, threads 46 are provided on the exterior of the portion of core 30 which abuts tee 38, and threads 46 are of the same size and direction as threads 40. An annular, internally threaded top collar 48 is provided into which threads 44, 42 can be threaded so that handle 36 and tee 38 abut one another in substantially fluid sealing relationship. Similarly, bottom collar 50 is provided with internal threads of the same size and direction as threads 40, 46 so that threads 40 of tee 38 can be threaded into bottom collar 50 and threads 46 of core 30 can be threaded into bottom collar 50 to hold tee 38 and core 30 in substantially fluid sealing relationship with one another.

It will be appreciated that in other embodiments alternate means such as bayonet locks can be used to hold tee 38 in fluid sealing relationship with handle 36 and core 30.

A reinforced, semi-rigid, circular safety shroud 52 is horizontally disposed above bladder 18 concentrically around tee 38 and expanding radially outwardly therefrom. Tee 38 can generally be said to be part of handle 36, so that shroud 52 can generally be said to be concentrically disposed around handle 36. Shroud 58 is bonded, for example by sealing, to tee 38 of handle 36. Shroud 52 has a diameter only slightly less than the inner diameter of casing 12. It is not necessary that shroud 52 fluidly seal casing 12, but only that the gap between the circumference of shroud 52 and the interior walls of casing 12 be small enough to prevent most tools from passing by it.

An elongated tube 54 is adapted for placement within and through handle 36, tee 38 and core 30. The first end 56 of tube 54 is adapted for placement in fluid communicating relationship with a source of pressurized fluid (not shown). This source of pressurized fluid is a low pressure source generally restricted to introducing less than twenty pounds per square inch into tube 54. Second end 58 of tube 54 is in fluid communicating relationship with the interior of bladder 18 through an aperture 60 in core 30. Tube 54 bends at elbow 62 to redirect the pressurized fluid in tube 54 from a vertical direction to a horizontal direction.

A tributary line 64 intersects tube 54 about halfway along its progression through the vertically disposed cross bar of tee 38. The first end 66 of tributary line 64 is in fluid communicating relationship with tube 54 and the second end 68 of tributary line 64 is sealed. Tributary line 64 is formed through the interior of the housing 70 which forms the portion of the tee is horizontally disposed within casing 12.

A dump valve line 72 is in fluid communicating relationship with tributary line 64 and is disposed completely transversely through tributary line 64, therefore presenting an upwardly extending branch and a downwardly extending branch off of tributary line 64. A plug 74 is provided for placement in dump valve line 72. The plug is comprised of a cylindrical shank 76 placed through dump valve line 72 and eyelet 78 which is connected to a portion of shank 76 that extends upwardly through an opening in shroud 52. Shank 76 of plug 74 is provided with suitable seals such as O-ring seals 80, 82, 84 which are circumferentially disposed around shank 76 within grooves provided on shank 76 for this purpose. Seal 80 is located on the outside of housing 70 with seal 80 contiguously abutting the outside of housing 70 to act as a retainer ring, thereby preventing accidental or inadvertant dislodgement of plug 74. Seal 82 is circumferentially disposed around shank 76 within dump valve line 72 and fluidly seals the bottom branch of dump valve line 72 to prevent the egress of fluid from tributary line 64 when plug 74 is in a selectively sealing position. Similarly, seal 84 is circumferentially disposed around shank 76 in the top branch of dump valve line 72 leading from tributary line 64 to the top side of housing 70. Seal 84 prevents the egress of fluid from tributary line 64 into dump valve line 72 and thence to the surrounding atmosphere. Accordingly, plug 74 selectively seals tributary line 64 and prevents the escape of pressurized fluid therefrom when plug 74 is in a sealing position with seals 80, 82, 84 located in the position shown in FIG. 2.

Dump valve cord 86 is provided as an example of a means for moving plug 74 from the sealing position shown in FIG. 2 in which fluid in tributary line 64 is prevented from escaping through dump valve line 72 to an open position (not shown) in which fluid from the interior of bladder 18 may escape through tube 54, tributary line 64 and dump valve line 72. When enough upward pressure is exerted by an operator on dump valve cord 86 in the direction indicated by arrow 88, such that the retaining effect of seal 80 is overcome either by displacement, shearing or ejection off of shank 76, then plug 74 is pulled out of dump valve line 72. When seals 82, 84 are no longer present to prevent the escape of fluid from tributary line 64, the pressurized fluid in the interior bladder 18 is permitted to flow into second end 58 of tube 54 and thence upwardly to tributary line 64 and through dump valve line 72 so that the pressurized fluid contents of bladder 18 can be emptied into the surrounding atmosphere. The plug therefore provides a convenient and quick means for deflating the bladder in case of an emergency or when it is time to remove bladder 18 from casing 12.

A relief valve line 90 is disposed in fluid communicating relationship with tributary line 64 intermediate tube 54 and dump valve line 72, said relief valve line 90 passing only to one side of the tributary line 64 and not being disposed in fluid communicating relationship through line 64 (as was the case with dump valve line 72). A spring actuated relief valve 92 is disposed in relief valve line 90 and in the embodiment shown in FIG. 1, projects upwardly through an opening in shroud 52. A check valve 94 is disposed within relief valve 92 and is actuated to open only when the pressure in tributary line 64 exceeds the safe prssure with which bladder 18 may be inflated. Since bladder 18 is generally a low pressure vessel, relief valve 92 usually opens only when the pressure being introduced through tube 54 exceeds about 4–20 psi. Check valve 94 can be, of course, selected from a wide variety of factory pre-set pressures to accommodate different strength bladders. Relief valve 92 also whistles when check valve 94 opens, thereby providing an audible signal to the person introducing pressurized fluid into first end 56 of tube 54 that in incorrect pressure source is being used to inflate bladder 18 and it and must be disconnected.

A plurality of retriever cords 96 are disposed through opening 26 in loops 24 to provide a means for assisting in pulling bladder 18 out of casing 12 when it becomes necessary to remove it. Cords 96 pass through retriever cord passageways 98 in shroud 52.

In operation, bladder 18 is lowered into mouth 14 of casing 12 using handle 36 and retriever cords 96 until bladder 18 is one to two feet below mouth 14 with shroud 52 being disposed even closer to mouth 14. Pressurized fluid is then introduced through first end 56 into tube 54 and thence to the interior of bladder 18 through second end 58 of tube 54. The fluid being introduced is usually in the range of about 4 psi which expands bladder 18 into at least partially sealing relationship with the surrounding walls of casing 12. Once bladder 18 is expanded, it provides an obstruction so that tools which are dropped into mouth 14 cannot pass by it.

Some tools are very heavy or sharp, and the kinetic energy they gain in their downward path towards bladder 18 might cause them to puncture bladder 18. In order to reduce the likelihood of such an event, shroud 52 is provided to break the impact of the tool as it falls. For example, the wrench 10 is shown in FIG. 1 falling into mouth 14 and having its downward progression stopped by shroud 52. In some cases, if the wrench 10 is not very heavy, it will come to rest on shroud 52. However, if the tool is heavier, it will deform shroud 52, fall off of it and come to rest on bladder 18 which is more suited for holding heavier objects. The primary purpose of shroud 52 is to reduce the kinetic energy of falling tools to prevent damage to the bladder.

When tools are dropped into casing 12 while the bladder is in use, they will come to rest a foot or two beneath mouth 14 so that a worker merely need reach into mouth 14 to pull the tools, such as wrench 10, out of casing 12. This eliminates the costly, time consuming and difficult procedure of fishing in the bottom of the casing for dropped or lost tools.

If drilling mud or other fluids such as flammable gases begin to build up on downhole side 20 of bladder 18, check valve 32 opens to permit the fluids to pass from side 20 to side 22 of bladder 18. These fluids are then conveyed through the vertically disposed cross bar of tee 38 and thence upwardly into handle 36 and to a distance above mouth 14 of casing 12. Accordingly, if workers are for example welding near the open mouth 14 of casing 12, flammable gases will be vented to a distance above them thereby preventing ignition of the flammable gases and a resulting fire.

If an operator attempts to introduce fluid under a pressure that is so great that it will damage bladder 18, the pressure of the fluid opens check valve 94 in relief valve 92 and vents the excess pressure to the atmosphere. When this venting occurs, relief valve 90 also emits an audible whistle which alerts the operator that the wrong pressure source is being used to inflate the bladder.

When an operator desires to deflate the bladder either during operation or after termination of work around the well casing, upward pressure is exerted in the direction of arrow 88 on dump valve cord 86 to move plug 74 from its sealing position shown in FIG. 2 to a position outside of dump valve line 72 so that pressurized fluid in the interior of bladder 18 can escape to the atmosphere through tube 54, tributary line 64 and dump valve line 72. In this fashion, the bladder is quickly deflated so that it can be removed from the casing without difficulty.

Figure 3:
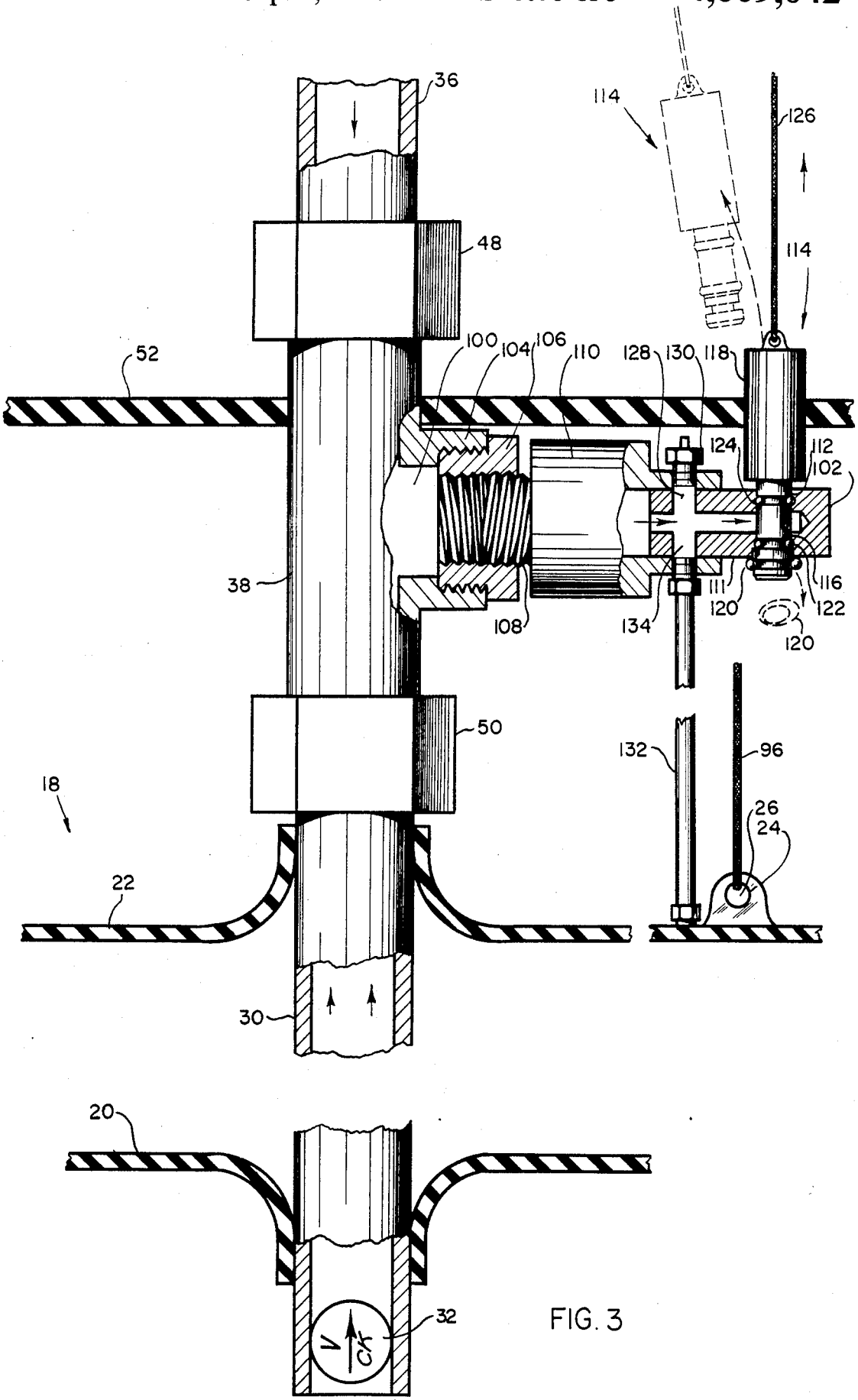
FIG. 3 is a view similar to FIG. 2 showing a second embodiment of the invention in which pressurized fluid passes through the handle instead of the elongated tube.

In the second embodiment of the invention shown in FIG. 3, an alternate structure for introducing pressurized fluid into the bladder is shown in which like parts to those shown in FIGS. 1 and 2 bear corresponding reference numerals. The aspects of the second embodiment which differ from those shown in the first embodiment can be identified by those reference numerals beginning with 100.

A tributary line 100 intersects the tee 38 of handle 36, the first end of tributary line 100 being in fluid communicating relationship with the hollow interior of the tee portion 38 of handle 36. The second end 102 of tributary line 100 is sealed, as shown at 102.

Looking in greater detail at tributary line 100, it is comprised of an internally threaded orifice 104 which is adapted for receiving in fluid sealing relationship externally threaded collar 106. Conduit 108 communicates with check valve 110, and check valve 110 permits the flow of pressurized fluid from the left to the right, as viewed in FIG. 3, but not from the right to the left. A cylindrical housing 111 projects outwardly from a cylindrical opening in the righthand side of check valve 110. Dump valve line 112 is in fluid communicating relationship with the extension of tributary line 100 that runs longitudinally through housing 111, dump valve line 112 having first and second branches for communicating with opposite sides of housing 111. Therefore, dump valve line 112 can be said to be transverse through tributary line 100.

A plug 114 is provided for placement within dump valve line 112. Plug 114 is comprised of shank 116 and enlarged, cylindrical section 118 which projects upwardly and through an opening in shroud 52. Shank 116 is provided with first seal 120 which is an O-ring seal configured to fit around the periphery of shank 116 in a groove provided for the purpose. In this fashion, first seal 120 is contiguous with the bottom wall of housing 110, and acts as a stop to prevent plug 114 from being accidentally disengaged from dump valve line 112.

Shank 116 is further provided with second seal 122 and third seal 124 within both branches of dump valve line 112 for selectively preventing fluid in tributary line 100 from escaping through dump valve line 112 when plug 114 is in a sealing position shown in dark lines in FIG. 3.

A dump valve cord 126 is provided for moving plug 114 from the sealing position shown in dark lines in FIG. 3 in which fluid in tributary line 100 is prevented from escaping through dump valve line 112 to an open position (shown in phantom in FIG. 3) in which fluid from bladder 18 may escape through said dump valve line 112, as described in greater detail below.

A relief valve line 128 is transversely disposed through tributary line 100 and is in fluid communicating relationship therewith, relief valve line 128 having first and second branches projecting above and below tributary line 100 respectively. A relief valve 130 is disposed in a top branch of relief valve line 128 and is actuated to open when pressure being introduced into the system exceeds the safe pressure with which bladder 18 may be expanded. Generally speaking, the maximum pressure with which bladder 18 is usually expanded should not exceed about 20 psi, and in fact most bladders of the type contemplated by this invention can be inflated with around 4 psi pressure.

A delivery line 132 is disposed in fluid communicating relationship between the second branch 134 of relief valve line 128 and the interior of bladder 18. Delivery line 132 is, in this preferred embodiment, a flexible hose for conveying the pressurized fluid introduced through handle 36 and into tributary line 100 through check valve 110 and into delivery line 132. Since check valve 32 is normally closed, it prevents the passage of the pressurized fluid being introduced through handle 36 to the downhole side 20 of bladder 18. Accordingly, all the pressure introduced through handle 36 flows into tributary line 100 and thence into delivery line 132 for inflating the bladder. Further, when the source of pressurized fluid in handle 36 is intentionally or accidentally interrupted or lost then check valve 110 will close thereby trapping pressurized fluid inside bladder 18. This mechanism prevents the sudden accidental or unplanned deflation of bladder 18.

Although a specific embodiment of the invention has been described in connection with work around an oil well casing, the bladder could also be used in openings such as water wells or any other opening in the ground around which people work.

The operation of the second embodiment shown in FIG. 3 is similar to that shown in the embodiment of FIGS. 1 and 2. The opening at the top of handle 36 is connected to a source of pressurized fluid, and this fluid flows downwardly through handle 36.

The method for preventing tools from falling into well casing 12 comprises placing bladder 18 in casing 12 adjacent the mouth 14 of the upper end of casing 12 and then inflating the bladder to prevent tools from falling into the casing. In other embodiments, the method is expanded by providing a vent for conveying gases passed through core 30 into handle 36 and to a safe distance above mouth 14 of casing 12 to prevent workers around mouth 14 from coming into contact with the pressurized fluids being passed from the downhole side 20 of bladder 18.

I claim:

1. A casing safety device for preventing tools from falling into a well casing, comprising:

an inflatable, resilient bladder for placement in said well casing adjacent the upper end of said casing, said bladder being conformable in at least partially sealing relationship to the walls of said casing when inflated;

means for introducing pressurized fluid into said bladder to inflate it;

a hollow core for said bladder through which fluid may pass from the downhole side of said bladder to the top side thereof;

a check valve for permitting the flow of fluid from the downhole side of said bladder; and a vent for conveying fluid passed through said check valve from the downhole side of said bladder to a distance above said casing.

2. A casing safety device for preventing tools from falling into a well casing, comprising:

an inflatable, resilient bladder for placement in said well casing adjacent the upper end of said casing, said bladder being conformable in at least partially sealing relationship to the walls of said casing when inflated;

means for introducing pressurized fluid into said bladder to inflate it;

a semi-rigid shroud disposed between said bladder and the mouth of said casing to reduce the impact of falling tools; and a dump valve for releasing pressurized fluid from said bladder.

3. The device of claim 2 wherein said vent comprises a hollow, elongated handle in fluid communicating relationship with said core.

4. The device of claim 3 wherein said means for introducing pressurized fluid into said bladder is comprised of an elongated tube for placement within said handle and core, the first end of said tube being adapted for placement in fluid communicating relationship with a source of pressurized fluid, the second end of said tube being in fluid communicating relationship with the interior of said bladder.

5. The device of claim 4 wherein said dump valve is comprised of:

a tributary line off said elongated tube, the first end of said tributary line being in fluid communicating relationship with said elongated tube, the second end of said tributary line being sealed;

a dump valve line in fluid communicating relationship with said tributary line and transversely disposed therethrough, at least one terminus of said dump valve line being in fluid communicating relationship with the atmosphere;

a plug for placement in said dump valve line, said plug being provided with a seal within said dump valve line for selectively preventing fluid in said tributary line from escaping through said dump valve line; and means for moving said plug from a sealing position to an open position in which fluid from said bladder may escape through said dump valve line.

6. The device of claim 5 wherein said tributary line is provided with a relief valve which opens when pressure introduced through said tributary line exceeds the pressure with which said bladder may safely be expanded without damaging the bladder.

7. The device of claim 6 further comprising a retrieval cord attached to said bladder.

8. The device of claim 7 wherein the second end of said elongated tube is placed through an aperture in said core so that pressurized fluid can be introduced into said bladder, and means for sealing the aperture between the periphery of said tube and the aperture so that fluid does not escape from said bladder into said core.

9. The device of claim 5 wherein said means for introducing pressurized fluid into said bladder comprises:

a relief valve line transversely disposed through said tributary line and in fluid communicating relationship therewith, said relief valve line having first and second branches on either side of said tributary line, and a relief valve disposed within the first branch of said relief valve line;

a delivery line disposed in fluid communicating relationship between the second branch of said relief valve line and the interior of said bladder; and a check valve disposed within said tributary line between said elongated tube and delivery line for permitting the flow of pressurized fluid from said elongated tube to said bladder while preventing the flow of fluid from said bladder into said elongated tube.

10. A casing safety device for preventing tools from falling into a well casing and for venting downhole gases to a distance above said well casing, comprising:

an inflatable, resilient bladder for placement in said well casing adjacent the upper end of said casing, said bladder being conformable in at least partially sealing relationship to the walls of the casing when inflated;

a hollow core for said bladder through which fluid may pass from the downhole side of said bladder to the top side thereof;

a check valve within said core for permitting the flow of fluid from the downhole side of said bladder;

a hollow, elongated handle in fluid communicating relationship with said core for venting fluid passed through said check valve in the core to a distance above said casing;

a semi-rigid circular shroud concentrically disposed around said handle between said bladder and the mouth of said casing to reduce the impact of falling tools;

an elongated tube for placement within said handle and core, the first end of said tube being adapted for placement in fluid communicating relationship with the source of pressurized fluid, the second end of said tube being in fluid communicating relationship with the interior of said bladder through an aperture in said core;

a tributary line intersecting said elongated tube, the first end of said tributary line being in fluid communicating relationship with said elongated tube, the second end of said line being sealed; a dump valve line in fluid communicating relationship with said tributary line and transverse therethrough;

a plug for placement in said dump valve line, said plug being provided with seals for placement within said dump valve line on both sides of said tributary line for selectively preventing fluid in said tributary line from escaping through said dump valve line when said plug is in a sealing position;

means for moving said plug from a sealing position in which fluid in said tributary line is prevented from escaping through said dump valve line to an open position in which fluid from said bladder may escape through said elongated tube, tributary line and dump valve line;

a relief valve line in fluid communicating relationship with said tributary line intermediate said elongated tube and dump valve line, and a relief valve disposed in said relief valve line which opens when pressure introduced through said tributary line exceeds about 20 psi; and a retriever cord attached to said bladder.

11. A casing safety device for preventing tools from falling into a well casing and for venting downhole gases to a distance above said well casing, comprising:

an inflatable, resilient bladder for placement in said well casing adjacent the upper end of said casing, said bladder being conformable in at least partially sealing relationship to the walls of the casing when inflated;

a hollow core for said bladder through which fluid may pass from the downhole side of said bladder to the top side thereof;

a check valve within said core for permitting the flow of fluid from the downhole side of said bladder but preventing the flow of fluid from said core to the downhole side of said bladder;

a hollow elongated handle in fluid communicating relationship with said core for venting fluid passed through said check valve in the core to a distance above said casing;

a semi-rigid circular shroud concentrically disposed around said handle between said bladder and the mouth of said casing to reduce the impact of falling tools;

a tributary line intersecting said handle, the first end of said tributary line being in fluid communicating relationship with the hollow interior of said handle, the second end of said line being sealed;

a dump valve line in fluid communicating relationship with said tributary line and transverse therethrough;

a plug for placement in said dump valve line, said plug being provided with seals for placement within said dump valve line on both sides of said tributary line for selectively preventing fluid in said tributary line from escaping through said dump valve line when said plug is in a sealing position;

means for moving said plug from a sealing position in which fluid in said tributary line is prevented from escaping through said dump valve line to an open position in which fluid from said bladder may escape through said dump valve line;

a relief valve line transversely disposed through said tributary line and in fluid communicating relationship therewith, and a relief valve disposed within a first branch of said relief valve line which opens when pressure introduced through said tributary line exceeds about 20 psi;

a delivery line disposed in fluid communicating relationship between the second branch of said relief valve line and the interior of said bladder;

a check valve disposed within said tributary line between said handle and relief valve line for permitting the flow of pressurized fluid from said handle to said relief valve line but preventing the flow of pressurized fluid from said bladder into said handle; and a retriever cord attached to said bladder.

12. A method for preventing tools from falling into a well casing and for venting downhole gases to a distance above said casing, comprising:

placing an inflatable, resilient bladder in said well casing, said bladder having a hollow core through which gases may pass from the downhole side of said bladder to the top side thereof;

inflating said bladder; and providing a vent for conveying gases passed through said core to a distance above said casing.

13. A device for preventing objects from falling into an opening in the ground, comprising:

an inflatable, resilient bladder for placement in said opening adjacent the upper end of said opening, said bladder being conformable in at least partially sealing relationship to the walls of said opening when inflated;

means for introducing pressurized fluid into said bladder to inflate it;

a hollow core for said bladder through which fluid may pass from the downhole side of said bladder to the topside thereof;

a check valve for permitting the flow of fluid from the downhole side of said bladder; and a vent for conveying fluid past through said check valve from the downhole side of said bladder to a distance above said opening in the ground.

14. A device for preventing objects from falling into and opening in the ground, comprising:

an inflatable, resilient bladder for placement in said opening adjacent the upper end of said opening, said bladder being conformable in at least partially sealing relationship to the walls of said opening when inflated;

means for introducing pressurized fluid into said bladder to inflate it; and a dump valve for releasing pressurized fluid from said bladder.

15. The device of claim 14 wherein said vent comprises a hollow, elogated handle in fluid communicating relationship with said core.

16. The device of claim 15 wherein said means for introducing pressurized fluid into said bladder is comprised of an elongated tube for placement within said handle and core, the first end of said tube being adapted for placement in fluid communicating relationship with a source of pressurized fluid, the second end of said tube being in fluid communicating relationship with the interior of said bladder.

17. The device of claim 16 wherein said dump valve is comprised of:

a tributary line off said elongated tube, the first end of said tributary line being in fluid communicating relationship with said elongated tube, the second end of said tributary line being sealed;

a dump valve line in fluid communicating relationship with said tributary line and transversely disposed therethrough, at least one terminus of said dump valve line being in fluid communicating relationship with the atmosphere;

a plug for placement in said dump valve line, said plug being provided with a seal within said dump valve line for selectively preventing fluid in said tributary line from escaping through said dump valve line; and means for moving said plug from a sealing position to an open position in which fluid from said bladder may escape through said dump valve line.

18. The device of claim 17, wherein said tributary line is provided with a relief valve which opens when pressure introduced through said tributary line exceeds the pressure with which said bladder may safely be expanded without damaging the bladder.

19. The device of claim 18 further comprising a retrieval cord attached to said bladder.

20. The device of claim 19, wherein the second end of said elongated tube is placed through an aperture in said core so that pressurized fluid can be introduced into said bladder, and means for sealing the aperture between the periphery of said tube in the aperture so that fluid does not escape from said bladder into said core.

21. The device of claim 17 wherein said means for introducing pressurized fluid into said bladder comprises:

a relief valve line transversely disposed through said tributary line and in fluid communicating relationship therewith, said relief valve line having first and second branches on either side of said tributary line, and a relief valve disposed within the first branch of said relief valve line;

a delivery line disposed in fluid communicating relationship between the second branch of said relief valve line and the interior of said bladder; and a check valve disposed within said tributary line between said elongated tube and delivery line for permitting the flow of pressurized fluid from said elongated tube to said bladder while preventing the flow of fluid from said bladder into said elongated tube.

* * * * *